US011225849B2

(12) United States Patent
McGarian

(10) Patent No.: US 11,225,849 B2
(45) Date of Patent: Jan. 18, 2022

(54) TOOL AND METHOD FOR CUTTING THE CASING OF A BORE HOLE

(71) Applicant: Bruce McGarian, Aberdeen Grampian (GB)

(72) Inventor: Bruce McGarian, Aberdeen Grampian (GB)

( * ) Notice: Subject to any disclaimer, the term of this patent is extended or adjusted under 35 U.S.C. 154(b) by 0 days.

(21) Appl. No.: 16/630,707

(22) PCT Filed: Jul. 12, 2018

(86) PCT No.: PCT/GB2018/051986
§ 371 (c)(1),
(2) Date: Jan. 13, 2020

(87) PCT Pub. No.: WO2019/016523
PCT Pub. Date: Jan. 24, 2019

(65) Prior Publication Data

US 2021/0079749 A1 Mar. 18, 2021

(30) Foreign Application Priority Data

Jul. 19, 2017 (GB) ..... 1711634

(51) Int. Cl.
*E21B 29/00* (2006.01)
*E21B 34/14* (2006.01)
(Continued)

(52) U.S. Cl.
CPC ..... *E21B 29/005* (2013.01); *E21B 33/12* (2013.01); *E21B 33/138* (2013.01); *E21B 34/142* (2020.05); *E21B 2200/06* (2020.05)

(58) Field of Classification Search
CPC ..... E21B 29/005; E21B 34/142; E21B 33/13; E21B 23/04; E21B 34/14
See application file for complete search history.

(56) References Cited

U.S. PATENT DOCUMENTS 2,799,479 A 7/1957 Kammerer
3,339,647 A 9/1967 Kammerer, Jr.
(Continued)

FOREIGN PATENT DOCUMENTS

CN 202000941 U 10/2011
GB 2348898 A 10/2000
(Continued)

OTHER PUBLICATIONS

International Search Report and Written Opinion for Application No. PCT/GB2018/051986 dated Oct. 22, 2018 (20 pages).
(Continued)

*Primary Examiner* — Catherine Loikith
(74) *Attorney, Agent, or Firm* — Michael Best & Friedrich LLP

(57) ABSTRACT

A cutting tool includes an elongate main body having inlet and outlet ends with a fluid flow path defined therebetween. A piston is mounted within the main body and longitudinally movable with respect to the main body. One or more cutters are moveable between retracted and deployed positions. The piston and each cutter engage one another so that longitudinal movement of the piston with respect to the main body moves each cutter between the deployed position and the retracted position. A flow regulator is operable to divert fluid flowing into the inlet end of the tool selectively along a first path, which passes the through the piston to the outlet end of the tool, and a second path, in which the fluid tends to drive the piston longitudinally with respect to the main body.

21 Claims, 4 Drawing Sheets

(51) Int. Cl.

| | |
|---|---|
| ***E21B 33/13*** | (2006.01) |
| ***E21B 33/12*** | (2006.01) |
| ***E21B 33/138*** | (2006.01) |

(56) References Cited

U.S. PATENT DOCUMENTS

| | | | | |
|---|---|---|---|---|
| 3,554,305 | A * | 1/1971 | Kammerer, Jr. | E21B 10/345 175/268 |
| 3,684,009 | A | 8/1972 | Murray | |
| 5,584,350 | A | 12/1996 | Schnitker et al. | |
| 5,771,972 | A | 6/1998 | Dewey et al. | |
| 5,816,324 | A | 10/1998 | Swearingen et al. | |
| 5,829,518 | A | 11/1998 | Gano et al. | |
| 6,401,821 | B1 | 6/2002 | Kennedy et al. | |
| 6,722,452 | B1 * | 4/2004 | Rial | E21B 10/322 175/265 |
| 9,404,331 | B2 * | 8/2016 | Hekelaar | E21B 17/1078 |
| 2003/0098152 | A1 | 5/2003 | Kennedy et al. | |
| 2004/0222022 | A1 | 11/2004 | Nevlud et al. | |
| 2012/0186816 | A1 * | 7/2012 | Dirksen | E21B 7/00 166/297 |
| 2013/0026401 | A1 | 1/2013 | Burkhart et al. | |
| 2013/0199784 | A1 | 8/2013 | Swadi et al. | |
| 2014/0251616 | A1 | 9/2014 | O'Rourke et al. | |
| 2015/0191999 | A1 * | 7/2015 | Adam | E21B 23/004 166/374 |
| 2016/0319619 | A1 | 11/2016 | Hekelaar | |

FOREIGN PATENT DOCUMENTS

| | | | |
|---|---|---|---|
| WO | 2012088102 | A2 | 6/2012 |
| WO | 2014011162 | A1 | 1/2014 |
| WO | 2015185905 | A1 | 12/2015 |
| WO | 2017046613 | A1 | 3/2017 |

OTHER PUBLICATIONS

Search Report issued from the United Kingdom Patent Office for related Application No. GB1711634.4 dated Nov. 13, 2017 (3 pages).

* cited by examiner

TOOL AND METHOD FOR CUTTING THE CASING OF A BORE HOLE

CROSS-REFERENCE TO RELATED APPLICATION DATA

This application is a U.S. national phase entry of International Application No. PCT/GB2018/051986, filed Jul. 12, 2018, which claims priority to GB Patent Application No. 1711634.4, filed Jul. 19, 2017, the entire contents of which are incorporated herein by reference in their entirety.

BACKGROUND

This invention relates to a tool and method for cutting the casing of a bore hole, and in particular to a tool and method that readily allows the cutting and sealing of an abandoned wellbore.

Wellbores for oil drilling and the like typically comprise a circular bore formed through the earth's crust (referred to as the formation) lined with a pipe, formed from a robust material such as steel which is known as the casing.

Once a wellbore has been formed, it is often necessary to seal and abandon the wellbore. This may be because, for instance, the resources accessed through the wellbore have been depleted to the level where further use of the wellbore is not economically viable.

In the sealing and abandonment of a wellbore, a bridge plug (which may, for example, be hydraulic or mechanical) or the like may be set in the wellbore at a desired depth, and the bridge plug may be activated, for example (in the case of a hydraulic bridge plug) by a ball being pumped down the drill string from the surface, and landing in a seat, causing pressure to build up and set the bridge plug.

A quantity of cement or a similar substance may then optionally be displaced on top of the bridge plug to form a cement plug, further sealing the wellbore.

The casing of the wellbore may then be cut, at a position above the plug, so that the casing above the plug can be retrieved and re-used or discarded.

Examples of tools used in the cutting of the casing in a wellbore may be seen, for example, in WO 2017/046613 and US2016/0319619.

SUMMARY

It is an object of the present invention to seek to provide an improved tool for use in the process of abandoning wellbores.

Accordingly, one aspect of the present invention provides a cutting tool, comprising: an elongate main body having an inlet end and an outlet end, a fluid flow path being defined between the inlet and the outlet ends; a piston mounted within the main body and longitudinally movable with respect to the main body; one or more cutters, each cutter being moveable between a retracted position and a deployed position, wherein the piston and each cutter engage one another so that longitudinal movement of the piston with respect to the main body moves each cutter between the deployed position and the retracted position; and a flow regulator, operable to divert fluid flowing into the inlet end of the tool selectively along a first path, which passes the through the piston to the outlet end of the tool, and a second path, in which the fluid tends to drive the piston longitudinally with respect to the main body.

Advantageously, the piston has a bearing surface and wherein, when fluid flowing into the inlet end of the tool is diverted along the first path, the fluid does not, or substantially does not, come into contact with the bearing surface of the piston, and when fluid flowing into the inlet end of the tool is diverted along the second path, the fluid is diverted into contact with the bearing surface, and wherein pressurised fluid being in contact with the bearing surface tends to drive the piston longitudinally with respect to the main body.

Preferably, the flow regulator has one or more flow apertures which are at least partially occluded, in an initial configuration, and in a second configuration the flow apertures are exposed, allowing fluid to flow along the second path.

Conveniently, the cutting tool further comprises a seat in which an activation object may be received, and wherein the activation object at least partially occludes the first path when it is received in the seat.

Advantageously, the seat is formed in the flow regulator or in the piston.

Preferably, the cutting tool further comprises a biasing arrangement which biases the piston longitudinally with respect to the main body, and wherein, when fluid flowing into the inlet end of the tool is diverted along the second path and tends to drive the piston longitudinally with respect to the main body, the biasing arrangement tends to oppose this motion of the piston with respect to the main body.

Conveniently, in a first configuration the piston is prevented from longitudinal movement within the main body by a retaining arrangement, and in a second configuration the piston may move longitudinally with respect to the main body Advantageously, the retaining arrangement comprises one or more breakable or frangible elements.

Preferably, in the first configuration, the breakable or frangible elements pass through at least part of a wall of the main body, and protrude into an outer surface of the piston.

Conveniently, the piston has an upper surface, which faces the inlet end of the main body, and a lower surface, which faces the outlet end of the main body, and wherein the surface area of the upper surface is substantially equal to the surface area of the lower surface.

Advantageously, the piston has an upper surface, which faces the inlet end of the main body, and a lower surface, which faces the outlet end of the main body, and wherein the surface area of the upper surface is greater than the surface area of the lower surface, and preferably is at least 50% greater than the surface area of the lower surface.

Preferably, the upper surface comprises the bearing surface.

Conveniently, the cutting tool further comprises one or more ports extending from an inlet, positioned on or near a top end of the piston, to an outlet, which is in communication with an interior cavity of the piston, at a location below the flow regulator.

Advantageously, the inlet of the or each port is positioned outside the flow regulator so that fluid flowing along the second path may pass through the or each port.

Preferably, an internal cavity of the piston is, for at least a part of the length of the piston, offset with respect to a central longitudinal axis of the tool.

Conveniently, the internal cavity of the piston is offset with respect to a central longitudinal axis of the tool so that the internal cavity is nearer to the exterior of the tool on a first side of the tool, and the inlet of the or each port is provided on a second side, opposite to the first side, of the tool relative to the interior cavity.

Another aspect of the invention provides a method of sealing and cutting a wellbore, comprising the steps of: incorporating a cutting tool according to any preceding claim into a drill string; running the drill string into a wellbore; delivering a sealing substance through the drill string, including the cutting tool, to seal or partially seal the wellbore at a position below the cutting tool; changing the operation of the flow regulator so fluid flowing into the inlet end of the tool is diverted along the second path, so the piston is driven longitudinally with respect to the main body, driving each cutter into the deployed position; and rotating the drill string so that the cutters of the tool cut the casing of the wellbore.

Advantageously, the method further comprises the steps of: incorporating a plug arrangement into the drill string; activating the plug arrangement within the wellbore; and separating the remainder of the drill string from the plug arrangement.

Preferably, the step of delivering the sealing substance through the drill string comprises the step, after the plug arrangement has been set, of delivering the sealing substance onto the plug arrangement.

Conveniently, the sealing substance comprises a cement.

Advantageously, the step of changing the mode of operation of the flow diverter comprises the step of dropping an activation object through the drill string from the surface to a location within the tool.

Preferably the method further comprises the step, once the cutters of the tool have cut the casing of the wellbore, of removing the activation object from the location within the tool.

Conveniently, the step of removing the activation object from the location within the tool comprises the step of at least partially dissolving the activation object.

Advantageously, the step of removing the activation object from the location within the tool comprises the step of applying sufficient fluid pressure to the tool to drive the activation object out of the location within the tool.

Preferably, the method further comprises the steps of: including a retrieval arrangement in the drill string; and once the casing of the wellbore has been cut, engaging the casing by means of the retrieval arrangement and removing the casing at least partially from the wellbore.

Conveniently, the method includes the steps of: including a milling or drilling tool in the drill string; and after the delivery of the sealing substance through the drill string, removing some of the sealing substance using the milling or drilling tool.

BRIEF DESCRIPTION OF THE DRAWINGS

In order that the present invention may be more readily understood, embodiments thereof will now be described, by way of example, with reference to the accompanying figures, in which.

DETAILED DESCRIPTION

Figure 1:
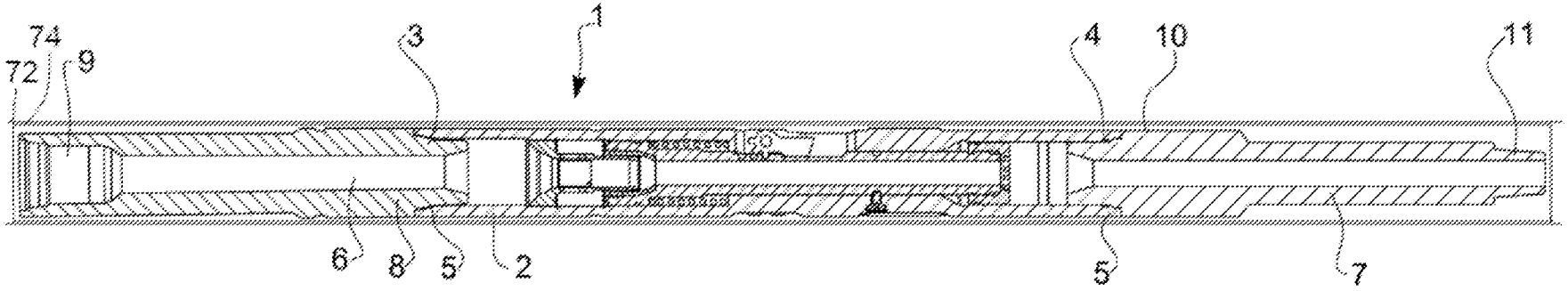
FIGS. 1 and 2 show a tool embodying the present invention in a first configuration.

FIG. 1 shows a tool 1 embodying the present invention. The tool 1 comprises an elongate main body 2, which is generally cylindrical in form and of a suitable size to be run into a wellbore 72 having a casing 74. The main body 2 has an inlet end 3 at one end thereof and an outlet end 4 at the opposite end thereof. In use of the tool 1, it is expected that the tool 1 will be oriented such that the inlet end 3 is uppermost, and the outlet end 4 is lowermost. In this document references to "top", "bottom", "above", "below" and the like are used in terms of this orientation, although it should be understood that these terms are used for convenience and do not rule out use of the tool in any other orientation.

Both the inlet and outlet ends 3, 4 have threaded connections 5. In the arrangement shown in FIG. 1, the tool 1 is attached to a top sub 6 and a bottom sub 7 by way of these threaded connections 5.

The top sub 6 is attached to the inlet end 3 of the tool 1 at its lower end 8, and its upper end 9 comprises a standard female threaded connection.

Similarly, the bottom sub 7 is attached to the tool 1 at its top end 10, and its bottom end 11 comprises a standard male threaded connection.

The combination of the tool and the top and bottom subs 6, 7 is therefore able to be integrated into a drill string, using the standard threaded connections, in a straightforward manner. In other arrangements the top and bottom subs 6, 7 may be omitted, with the tool 1 itself including the standard threaded connections at its ends.

Figure 2:
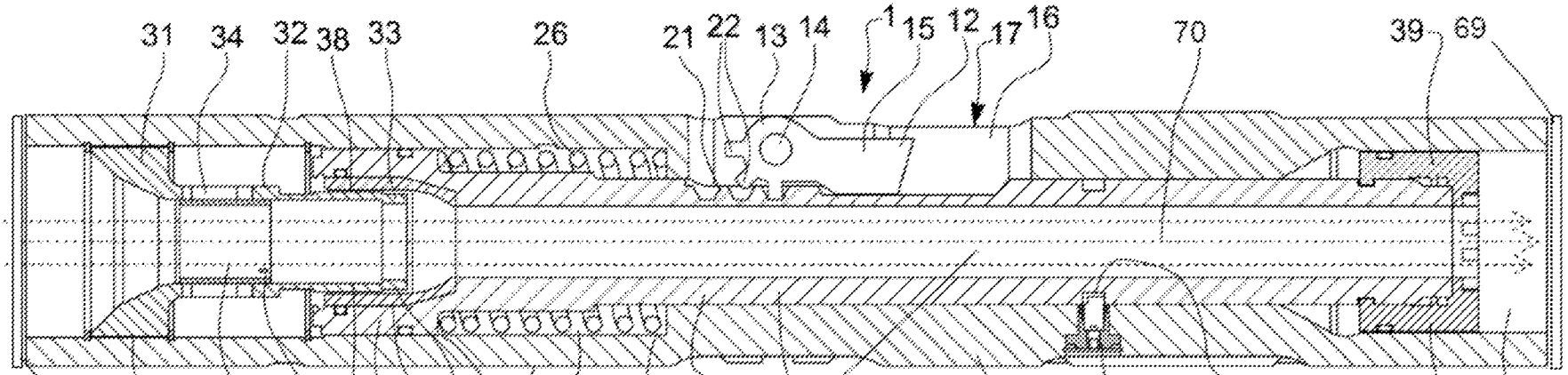

FIG. 2 shows a more close-up view of the internal components of the tool 1. The tool 1 comprises a plurality of cutters 12, positioned at radially spaced-apart positions around the circumference thereof. In the embodiment shown, the tool 1 has three cutters 12, which are regularly spaced around its circumference, although other numbers of cutters and/or kinds of angular spacing may also be used. Each cutter may be moved between a retracted position and a deployed position. In the retracted position, each cutter does not, or substantially does not, protrude beyond the outer diameter of the main body 2. In the deployed position, each cutter protrudes outwardly beyond the outer diameter of the main body 2. This will be discussed in more detail below.

In the example shown, each cutter 12 includes a mounting portion 13, which is rotatably mounted on a mounting pin 14, which is perpendicular or generally perpendicular to the main longitudinal axis of the tool 1 itself. The cutter 12 further comprises a cutting portion 15, generally taking the form of a blade, which extends away from the mounting portion 13.

Overall, each cutter 12 is preferably generally flat in configuration, and arranged so that the plane thereof is substantially perpendicular to, and passes through or close to, the main longitudinal axis of the tool.

It will therefore be understood that, when each cutter is in the deployed position, it protrudes radially or substantially radially outwards from the tool 1.

In the example shown, where the cutters 12 are provided the main body 2 of the tool 1 has a region 16 of increased thickness. In line with each of the cutters 12 a slot or window 17 is provided in the main body 2. In the retracted position, each cutter 12 is positioned within one of these slots or windows 17, preferably entirely accommodated within the thickness of the wall of the main body 2, and in the deployed position each cutter 12 protrudes outwardly through the slot or window 17.

The main body 2 is generally hollow, and has a main cavity 18 passing therethrough.

Positioned within the main cavity 18 is a piston 19, which is generally hollow and has a bore, referred to hereinafter as interior cavity 20, passing therethrough.

The piston 19 has a central region 37 which passes through, and preferably is a close fit within, the widened region 16 of the main body 2 (it will be understood that in this region 16, the internal diameter of the main body 2 is reduced, due to the increased wall thickness). The piston 19 is of a suitable size that it may slide longitudinally in either direction with respect to the main body 2.

In the region of the mounting portion 13 of each cutter 12, the outer surface of the piston 19 has a series of spaced-apart teeth 21 formed on its outer surface. These teeth 21 may extend around the entire circumference of the piston 19 or, as shown in the figures, a separate set of teeth 21 may be formed to be aligned with each cutter 12.

The mounting portion 13 of each cutter 12 has corresponding teeth 22 protruding therefrom. The teeth 21, 22 of the piston 19 and the mounting portion 13 engage and intermesh with one another, so that linear movement of the piston 19 causes rotational motion of the mounting portion 13 of the cutter 12.

The skilled reader will appreciate that the interaction between these teeth 21, 22 is akin to the operation of a rack and pinion.

In the arrangement shown in FIG. 2, one cutter 12 is visible, in the retracted position. It will be understood that, starting from this position, if the piston 19 moves linearly with respect to the main body 2 in the direction towards the outlet end 4 thereof, this will cause the mounting portion 13 of the cutter 12 to rotate so that the cutting portion 15 of the cutter 12 protrudes outwardly from the main body 2. In this position, the cutter 12 is in the deployed configuration.

In the preferred embodiment each cutter 12 may rotate through around 50°-60° to move from the retracted position into the deployed position. However, in other embodiments each cutter 12 may move through a greater or lesser angle to move into the deployed position. In some embodiments the cutters 12 may move through around 90° or around 45°.

In the initial, retracted position for each cutter 12 shown in FIGS. 1 and 2, each cutter 12 preferably lies against an outer surface of the piston 19, The piston 19 has an upper or inlet end 44, which is wider than the central region 37 thereof. Where the upper end 44 meets the central region 37, the upper end 44 presents a downward-facing shoulder 23. Similarly, at the upper end of the widened region 16 of the main body 2, an upward-facing shoulder 24 is formed. A cavity 25 is formed between the shoulders 23, 24, and a generally cylindrical compression spring 26 is provided in this cavity 25, positioned between the downward-facing shoulder 23 and the upward-facing shoulder 24. As the skilled reader will understand, this compression spring 26 biases the piston 19 upwardly with respect to the main body 2.

The upper end 44 of the piston 19 is open, and a widened recess 38 is formed at the opening. In the example shown in the figures, an insert 40 is provided in the widened recess 38. This insert 40 may be hardened to prevent or minimise damage to the widened recess 38, through fluid flow or contact with other components.

The piston 19 further has a lower or outlet end 27, which is positioned below the widened region 16 of the main body 2, and is wider than the central region 37 of the piston 19. The lower end 27 of the piston 19 is too wide to fit through the region 16 of the main body 2 which has a widened wall. The lower end 27 of the piston 19 is also open.

It is likely to be necessary to form the piston 19 in two or more parts, in order to allow the tool 1 to be assembled. In the example shown, the widened lower end 27 of the piston 19 is formed by attaching a generally annular collar 39 to the exterior of the piston 19. It will be understood that, in the production of the tool 1, the piston 19 will be inserted through the region 16 of the main body 2 that has a thickened wall, and the collar 39 can then be attached to the lower end of the piston 19.

In preferred embodiments the cross-sectional area of the upper surface of the piston 19 is equal, or approximately equal to the cross-sectional area of the lower surface of the piston 19. In other words, the upward-facing annular region of the widened upper end 44 of the piston is of the same, or approximately the same, area as the downward-facing annular surface of the widened lower part 27 of the piston 19.

This means that, when pressurised fluid surrounds the piston 19, the piston 19 is substantially balanced and will not be driven in either direction longitudinally with respect to the main body 2.

In the example shown, one or more shear screws 28 pass through the main body 2, in the widened region 16 thereof, and protrude inwardly into corresponding apertures 29 formed on the outer surface of the piston 19. In other embodiments, instead of separate apertures for each shear screw 28, an annular groove may be formed in the exterior surface of the piston 19, as shown in FIG. 2, into which one or more shear screws protrude.

It will therefore be understood that, in an initial configuration (shown in FIG. 2), the shear screws 28 provide a retaining arrangement to prevent movement of the piston 19 longitudinally with respect to the main body 2. However, the shear screws 28 may, in operation of the tool 1, be broken (discussed in more detail below), allowing relative longitudinal movement of the main body 2 and the piston 19. Other types of frangible connections may also be used instead of shear screws to provide the retaining arrangement.

The tool 1 further comprises a flow regulator 30, which in the illustrated embodiment takes the form of a flotel. The flow regulator 30 is positioned closer to the inlet end 3 of the tool 1 than the piston 19. The flow regulator 30 comprises a blocking portion 31, which is provided at its upper end (i.e. closest to the inlet end 5 of the tool 1), and completely or substantially completely fills the internal diameter of the main body 2. Fluid entering the inlet end 5 of the tool 1 therefore cannot flow around the blocking portion 31 of the flow regulator 30. The blocking portion 31 may have a seal, such as an O-ring, around its perimeter to form a seal against the interior of the main body 2.

The flow regulator 30 further comprises a delivery portion 32, which is generally cylindrical, hollow and elongate, and protrudes from the blocking portion 31 in the direction towards the outlet end 4 of the tool 1. The delivery portion 32 has a sealing region 41, which fits closely within the widened recess 38 (or the insert 40 therein). In some embodiments this close fit completely blocks the recess 38 so that fluid cannot flow or pass between the sealing region 41 and the interior of the recess 38. However, in preferred embodiments some fluid may pass between the sealing region 41 and the interior of the recess 38. This may be achieved, for example, by having a bypass area in the form of one or more grooves or cut-outs formed in the delivery portion 32 (in particular, in the sealing region 41 thereof) and/or in the interior of the recess 38. In some examples the flow area between the sealing region 41 and the interior of the recess may be equivalent to a pipe having a 12/32" (0.95 cm) or 16/32" (1.27 cm) diameter.

The sealing region extends over at least a part of the length of the delivery portion 32. The delivery portion 32 also has a narrowed region 42 at its distal end, which has a reduced diameter compared to the sealing region 41.

The blocking portion 31 has an aperture formed therethrough which is in fluid connection with the delivery portion 32. The delivery portion 32 is open at its lower end 33. Its lower end 33 is fitted into the widened recess 38 at the upper end 44 of the piston 19, and the interior of the delivery portion 32 is in fluid communication with the interior of the piston 19.

Part way along its length the delivery portion 32 has a series of flow apertures 34 formed therethrough. Each flow aperture 34 passes through the entire thickness of the wall of the delivery portion 32, and is preferably oriented radially or generally radially.

In an initial configuration, as shown in FIG. 2, a sleeve element 35 (which is preferably cylindrical in form) is positioned within the delivery portion 32, and aligned with the flow apertures 34. In preferred embodiments the sleeve element 35 is not a tight fit within the interior of the delivery portion 32, and fluid pressure can communicate through the flow apertures 34 between the interior of the delivery portion 32 and the exterior region immediately surrounding the delivery portion 32. However, when flow or circulation of drilling fluid through the tool 1 occurs, this flow of fluid is not communicated through the flow apertures 34.

The sleeve element 35 is initially held in place with respect to the delivery portion 32 of the flow regulator 30 by one more shear screws 36 or other frangible connections.

FIG. 2 shows the tool 1 in an initial configuration.

The interior cavity 20 of the piston 19 is relatively wide. In preferred embodiments, the internal diameter of the interior cavity 20 is at least $1/5^{th}$ of the total external diameter of the main body 2. In more preferred embodiments, the internal diameter of the interior cavity 20 is at least one quarter of the total overall external diameter of the main body 2.

In preferred embodiments the internal bore is at least around 2" (5.1 cm) in diameter, and may be 2.25" (5.7 cm) or at least around 2.25" (5.7 cm). The overall external diameter of the tool 1 may be 8.375" (21.3 cm) or therearound, or may be 8.25" (20.1 cm) or therearound. However, the invention is not limited to bores or tools of this size. The tool may be of any other suitable size, for instance 5.75" (14.6 cm) or 11.75" (29.9 cm).

In preferred embodiments, the internal diameter of the flow path through the flow regulator 30, including the internal diameter of the delivery portion 32, is of at least substantially the same diameter as that of the internal bore of the piston 19.

Importantly, in preferred embodiments a flow path is defined through the tool 1, in this initial configuration, which has a wide bore, and includes no significant internal obstacles or restrictions. In preferred embodiments, in the initial configuration the cross-sectional area of the flow path through the tool, at all points along the length of the tool, corresponds to that of a pipe having a diameter of at least 2" (5.1 cm). In yet more preferred embodiments, in the initial configuration the cross-sectional area of the flow path through the tool, at all points along the length of the tool, corresponds to that of a pipe having a diameter of at least 2.25" (5.7 cm).

In preferred embodiments the flow path through the tool 1, in the initial configuration, is centrally or substantially centrally disposed within the tool 1. Preferably, a central longitudinal axis of the tool 1 passes along the flow path, for at least a majority of the flow path. In more preferred embodiments, the central axis passes along the flow path for at least 80% of its length. In yet more preferred embodiments, the central axis passes along the flow path for 100%, or substantially 100%, of its length.

Use of the tool 1 will now be described.

Initially, the tool 1 is incorporated into a drill string, which (as the skilled reader will appreciate) may include many other components which are connected together end-to-end.

In preferred embodiments of the invention, a plug arrangement such as a bridge plug 69 (FIG. 2) is attached below the tool 1. The bridge plug 69 may be attached directly to the lower end of the tool 1, or one or more other tools/components may be positioned between the tool 1 and the bridge plug 69.

The drill string, including the tool 1 and the bridge plug 69, is run into a wellbore 72 in a known fashion. As this occurs drilling fluid of any suitable type may be circulated through the drill string, as the skilled reader will understand. The drilling fluid will pass into the inlet end 3 of the tool 1, through the flow regulator 30 and the interior cavity 20 of the piston 19, and out through the outlet end 4 of the tool 1. The fluid will not flow through the flow apertures 34 of the delivery portion 32 of the flow regulator 30. However, as mentioned above, fluid pressure within the delivery portion 32 will be communicated to the region immediately surrounding the delivery portion 32. This means that the fluid pressure experienced by the upper surface of the piston 19 will be the same (or substantially the same) as that experienced by the lower surface of the piston 19, and the piston will be in a pressure balanced state, and will not tend to be driven longitudinally in either direction with respect to the main body 2.

While (as mentioned above) drilling fluid may be circulated during this phase, this is not essential. The drill string may alternatively be filled with fluid from the surface or above the tool with no or minimal circulation.

When the bridge plug 69 is at a suitable depth, the plug is set, i.e. activated so that it grips onto the inner surface of the casing 74, for instance through one or more slips, and completely or substantially occludes the wellbore 72.

The bridge plug 69 may be activated hydraulically, through pressurised fluid within the drill string, mechanically (for instance by dropping a ball or other object through the drill string, including the tool 1, to reach the bridge plug 69), or in another suitable way.

Once the bridge plug 69 has been set, the integrity of the bridge plug 69 and the casing 74 can be tested, by means of a pressure test. If the integrity is found to be lacking/unacceptable through this pressure test, it may be necessary to set another bridge plug in the wellbore 72, displace further cement through the drill string to create a further barrier in the wellbore 72, and/or move the tool to a different depth to cut the casing in a different location. It may even be necessary to remove the initial bridge plug before setting another bridge plug in place.

Once the bridge plug 69 has been set with respect to the wellbore 72, and any pressure testing has been successfully completed, the remainder of the drill string (along with the tool 1) is disengaged from the bridge plug 69. This could be done, for example, through rotation of the drill string to disengage a threaded connection between the bridge plug 69 and the remainder of the drill string. In preferred embodiments, the components of the drill string are connected to one another through conventional right-hand threaded connections, but the connection between the bridge plug 69 and the next lowest component (which may be the tool 1) is a left-handed threaded connection. This means that, if the drill string is rotated clockwise, this will tend to tighten the connections between the majority of the components, but to disengage the threaded connection with the bridge plug 69.

Once the drill string has been disconnected from the bridge plug 69, the drill string can be lifted upwardly away from the bridge plug 69.

In preferred embodiments, a sealing substance such as a quantity of cement 70 is then pumped through the drill string, and out of the open end of the drill string to set and form a cement plug on top of the bridge plug 69.

It will be appreciated that the relatively wide bore passing through the tool will allow the ready delivery of cement through the tool. By contrast, many known tools for cutting a casing have relatively narrow fluid pathways, which include several bends or turns or are otherwise convoluted, and these known tools are therefore much less well-suited to the delivery of cement.

During this phase of operation the cement 70 may, for instance, be displaced at a rate of around 800 to 1000 litres per minute. Cement used for this purpose may have a specific gravity of around 1.9.

As cement 70 flows through the tool 1, cement will be prevented from passing through the flow apertures 34 of the delivery portion 32 of the flow regulator 30 by the sleeve element 35.

The displacement of cement 70 through the tool 1 is likely to produce a "surge" effect, and the presence of the compression spring 26 and shear screws 28 help to maintain the piston 19 in its correct position as this process is carried out.

The drill string is preferably raised as the cement 70 is displaced, so that the drill string remains above the cement 70 and does not become fixed by the cement in the borehole.

Once a suitable quantity of cement 70 has been displaced through the tool 1, regular circulating fluid/drilling fluid can once again be introduced through the drill string and to the tool 1. The drill string will be entirely above the cement plug at this stage. Once the cement has set, a pressure integrity test can be carried out to test the integrity of the cement plug, the bridge plug 69 and/or the casing 74.

The drill string is then raised so that the cutters 12 of the tool 1 are level or substantially level with the location at which the casing 74 of the wellbore 72 is to be cut.

When the cutting operation is to begin, a ball 68 is dropped through the drill string, and is carried by the drilling fluid (which at this stage may be introduced into the drill string with a low pump rate/low circulation rate) along the drill string until it reaches the inlet end 3 of the tool 1.

The drill string is then pressurised, without circulation of fluid.

Figure 3:
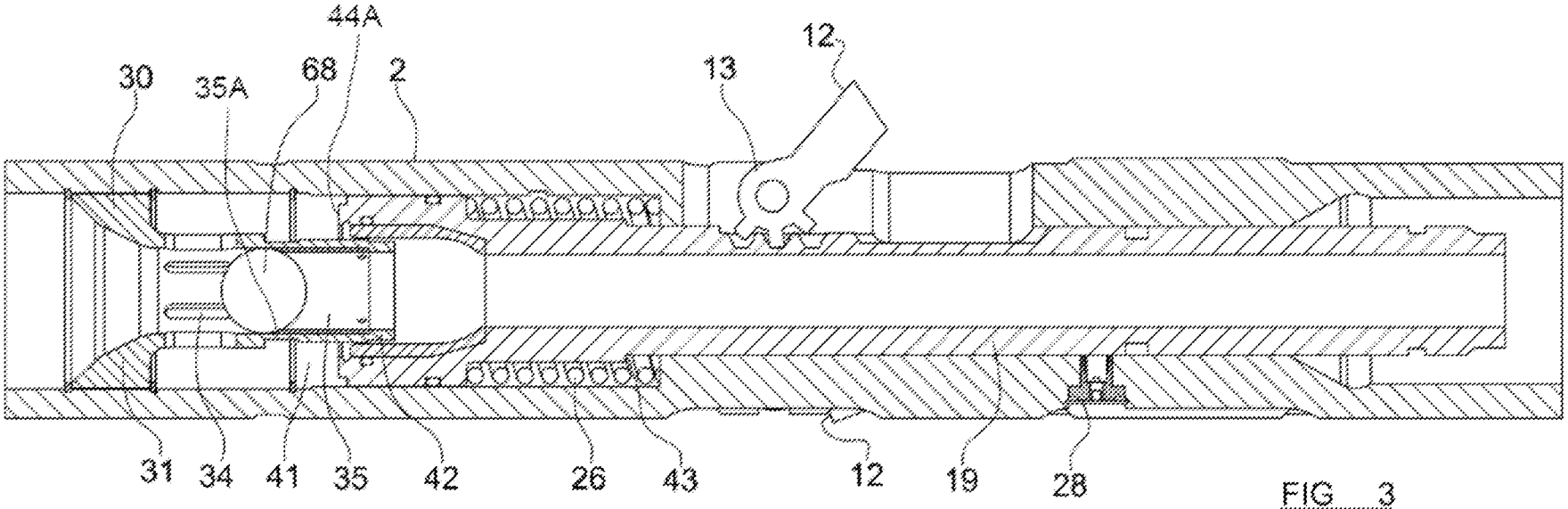
FIG. 3 shows the tool of FIGS. 1 and 2 in a second configuration.

FIG. 3 shows a close-up view of the flow regulator 30, when the ball 68 has arrived at the flow regulator 30.

The ball 68 is formed to have an outer diameter which is slightly less than the inner diameter of the delivery portion 32 of the flow regulator 30. However, the sleeve element 35 has an inner diameter which is less than the outer diameter of the ball 68. The ball 68 therefore lands on the upper edge of the sleeve element 35, and entirely or substantially entirely blocks the fluid flow path through the flow regulator 30. Thus, a seat 35A is formed in the flow regulator 30 by the sleeve element 35. Fluid pressure above the ball 68 drives the ball downwardly, rupturing the shear screws 36 which hold the sleeve element in place. The ball 68 and sleeve element 35 therefore travel downwardly, with respect to the flow regulator 30, until the sleeve element 35 lands on an upward-facing shoulder 38 formed within the delivery portion 32 of the flow regulator 30.

As can be seen in FIG. 3, the upper end of the blocking portion 31 of the flow regulator 30 may have one or more sloping surfaces, forming a funnel, to guide the ball 68 into the delivery portion 32 thereof when the ball arrives at the tool 1.

When the sleeve element 35 travels downwardly with respect to the delivery portion 32, the flow apertures 34 are exposed (i.e. no longer blocked by the sleeve element 35), and fluid may flow from the interior of the flow regulator 30 outwardly through the flow apertures 34.

In this configuration, flow of fluid through the lower end of the delivery portion 32 of the flow regulator 30 to the interior cavity 20 of the piston 19 is blocked by the ball 68 itself, which completely or substantially completely occludes (together with the sleeve element 35) the delivery portion 32 of the flow regulator 30.

As can be seen from FIG. 3, therefore, fluid delivered to the tool 1 through the drill string may no longer flow directly into the piston 19 through the delivery portion 32 of the flow regulator 30, but instead is diverted out through the flow apertures 34 into an annular chamber 75 which surrounds the delivery portion 32 of the flow regulator 30.

The fluid is then in contact with the uppermost annular surface, referred to as a bearing surface 44A, of the upper end 44 of the piston 19. Since the fluid is pressurised, and this pressure will not be matched by corresponding pressure acting on the bottom surface of the piston 19, this fluid exerts a downward force on the piston 19 with respect to the main body 2.

As this occurs, the shear screws 28 that initially joined the piston 19 to the main body 2 will break, allowing longitudinal movement between the piston 19 and the main body 2. The piston 19 will then be driven downwardly, against the biasing force of the compression spring 26, causing the cutters 12 to rotate outwardly towards the deployed position, as discussed above.

FIG. 3 shows the resulting configuration. It can be seen that, compared to the configuration shown in FIG. 2, the piston 19 has moved downwardly with respect to the main body 2, thus moving the cutters 12 into their deployed position.

The tool 1 must be rotated in order for the casing 74 to be cut. In preferred embodiments, rotation of the drill string will be commenced before the cutters 12 are moved to the deployed position. The drill string may, at this stage, be rotated at around 80 to 120 rpm, although different rotational speeds may be used depending on the particular application. The drill string will build up angular momentum during this phase, which will assist the early stages of the cutting operation. In other embodiments, however, the cutters may be moved into, or towards, the deployed position before any rotation of the drill string takes place.

The ball 68 is then dropped, with the result that the cutters 12 are rotated outwardly towards the deployed position. Rotation of the drill string will continue during the cutting operation, which in some embodiments may take a few minutes.

As the cutters 12 begin to cut the casing 74, they will be progressively rotated outwardly towards the deployed position, as a result of continued fluid pressure acting on the upper surface of the piston 19. As the interior surface of the casing 74 is cut, the cutters 12 will be able to rotate outwardly to a greater degree. As the cutters 12 rotate outwardly, the piston 19 will move progressively further downwardly with respect to the main body 2, further compressing the compression spring 26.

The length of the delivery portion 32 of the flow regulator 30, and the position of the flow regulator 30 within the main body 2, are set so that, when the piston 19 has moved downwardly with respect to the main body 2 by a certain amount, the sealing region 41 of the engagement portion 32 is completely removed from the recess 38 in the upper end of the piston 19. This means that fluid can now flow more freely around the lower end of the delivery portion 32 and through the interior cavity 20 of the piston 19. This position is shown in FIG. 3.

As discussed above, when the sealing region 41 of the delivery region 32 is received in the widened recess 38 of the piston 19, fluid can preferably flow between the exterior of the sealing region 41 and the interior of the recess 38, and the flow area may be equivalent to a pipe having a 12/32" (0.95 cm) or 16/32" (1.27 cm) diameter. When the sealing region 41 is removed from the recess 38, the resulting flow area around the narrowed region 42 and the recess is greater, and may be equivalent to a pipe having a diameter of 22/32" (1.8 cm).

In preferred embodiments, the flow area after the sealing region 41 is removed from the recess 38 is at least 1.5 times, and more preferably at least twice, the flow area before the sealing region 41 is removed from the recess 38.

At this point, there will be a pressure drop across the piston 19, which will be detectable from the surface. Moreover, the net downward force on the piston 19 will be greatly reduced.

It may, for example, be expected that the casing 74 will be cut when the cutters 12 reach an angle of 50° to 60° with respect to the main longitudinal axis of the tool 1. The length and/or position of the flow regulator 30 may therefore be chosen so that, when the cutters 12 reach this angle of rotation, the sealing region 41 of the delivery portion 32 is completely removed from the piston 19.

When the cutters 12 reach the desired angle, the resulting drop in fluid pressure will therefore be detectable from the surface, and operators at the surface will have an indication that the casing 74 has been successfully cut. In some embodiments an O-ring or other type of seal may be formed around the sealing region 41 of the delivery portion 32, which will lead to a more distinct and recognisable pressure drop as the sealing region 41 of the delivery portion 32 is completely removed from the piston 19.

As with conventional cutting tools, the torque that will need to be applied to the drill string to maintain the desired rotational speed during the cutting operation will be relatively high. Once the casing 74 has been cut, however, the resistance experienced by the cutters will drop, and this will lead to a drop on torque which will be detectable from the surface. However, a drop in torque could equally arise from the cutters having broken or failed. Having a drop in pressure, arising from the sealing region 41 being removed from the recess 38, provides a direct measurement of the extent to which the cutters 12 have been rotated outwardly, and hence gives a valuable second confirmation that the cutting operation has concluded successfully.

This drop in fluid pressure is likely to lead to a decrease in the net downward force on the piston 19. If the operators wish to continue further cutting, the flow rate can be increased, to increase the pressure and continue driving downward movement of the piston 19 with respect to the main body 2.

Figure 4:
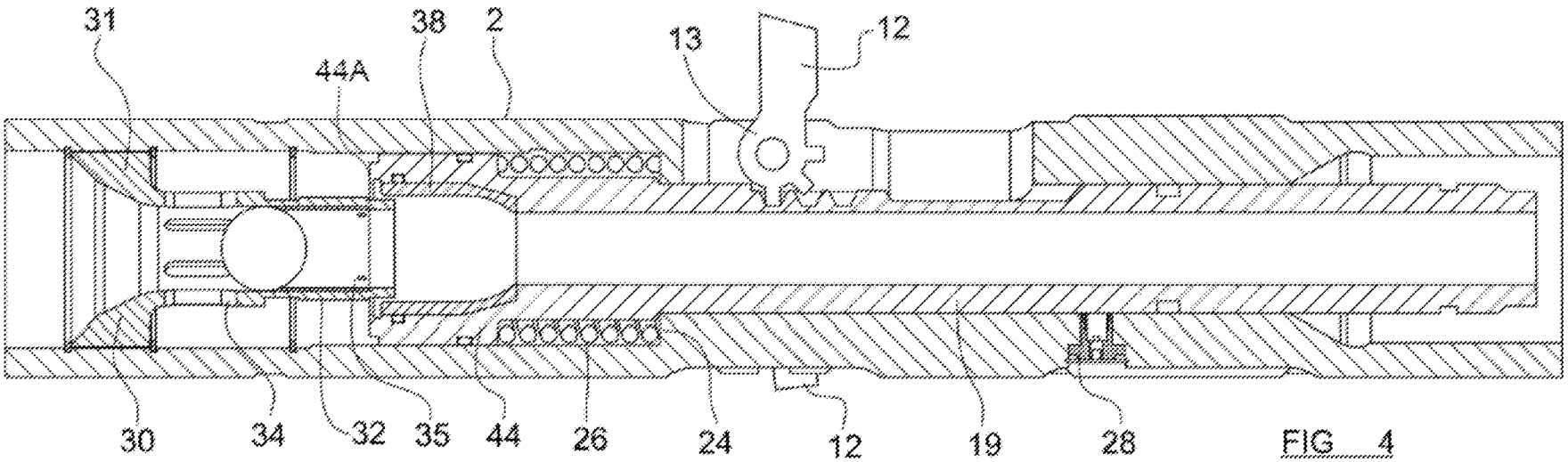
FIG. 4 shows the tool of FIGS. 1 and 2 in a further configuration.

As can be seen in (for example) FIG. 3, a downward-facing shoulder 43 is formed in the external surface of the piston 19, spaced apart from the widened upper end 44 thereof. The spacing of this shoulder 43 from the widened upper end 44 is such that, when the cutters 12 have rotated through 90° or approximately 90° from their initial position (shown in FIGS. 1 and 2), and protrude perpendicularly or substantially perpendicularly with respect to the longitudinal axis of the main body 2, the shoulder 43 comes into contact with the upward-facing shoulder 24 formed where the region 16 of increased thickness of the main body 2 begins. This position is shown in FIG. 4. The skilled reader will understand that this prevents rotation of the cutters 12 beyond this position.

In alternative embodiments, the downward-facing shoulder 43 could be placed at a different distance from the widened upper end 44 of the piston 19, so the shoulder 43 comes into contact with the upward-facing shoulder 24 formed where the region 16 of increased thickness of the main body 2 begins when the cutters are at a different angle, for instance 55° with respect to the longitudinal axis of the main body 2.

While the cutting operation is underway, and if the cutters 12 are extended to protrude at 90° or substantially 90° with respect to the longitudinal axis of the main body 2, the drill string may be raised or lowered. This may allow additional regions of casing 74 to be cut in an upward or downward direction, e.g. to create an opening in the casing 74 rather than simply cutting the casing 74 at one depth or level.

To stop the cutting operation, the fluid flow, and thus pressure, in the drill string is reduced or stopped. The compression spring 26 will then drive the piston 19 upwardly with respect to the main body 2, thus returning the cutters 12 to the retracted position.

As described above, when the piston 19 moves downwardly with respect to the main body past the sealing region 41 of the delivery portion 32 of the flow regulator 30, equal or substantially equal fluid pressure will act on the upper end lower surfaces of the piston 19, maintaining the piston in position.

In the embodiments shown the flow regulator 30 is fixed in place longitudinally with respect to the main body 2. However, in other embodiments the flow regulator 30 may float longitudinally within the main body 2. In these embodiments, there may be a stop member protruding from the inner wall of the main body 2 at a suitable location, either formed by a shoulder which is formed as part of the main body 2 or, for instance, a snap ring which is installed in a groove in the interior surface of the main body 2.

Before the ball 68 is dropped the delivery portion 32 of the flow regulator 30 may be received in the upper end of the piston 19, as shown in the attached figures. When the piston 19 is driven downwardly, the flow regulator 30 may initially move with the piston 19, but once the flow regulator 30 contacts the stop member, the flow regulator 30 will not move downward any further, and as the piston 19 continues to move downwardly with respect to the main body 2, the piston 19 will clear the sealing region 41 of the delivery portion 32 of the flow regulator 30, as discussed above.

If it is necessary to cut the casing 74 again in a further position, the drill string can be raised, or lowered (as appropriate), and the cutting sequence begun again, i.e. the drill string is rotated, and the flow and/or pressure in the drill string is increased so that the biasing force of the compression spring 26 is overcome and the cutters 12 are deployed once more.

This cutting sequence can be repeated as many times as is necessary.

Once the casing 74 has been cut, the drill string, including the tool 1, may be retrieved. The casing 74 itself may then also be retrieved, and this is likely to take place after the drill string has been raised.

Alternatively, a retrieval arrangement 76, shown schematically in FIG. 2, can be included in the drill string to allow the casing 74 to be engaged and lifted once it has been cut. For instance, the drill string may include a fishing tool such as a spear, and/or a pack-off arrangement, to grip or otherwise engage the casing 74 and raise the casing 74 along with the drill string itself. The skilled reader will appreciate how this may be achieved, and which kinds of retrieval arrangement will be most suitable for use.

It is envisaged that the retrieval arrangement 76 will be located above the tool 1 in the drill string, although this is not essential.

As discussed above, in preferred embodiments of the invention the piston 19 is substantially pressure balanced, in that the surface area of the top surface of the piston 19 is equal or substantially equal to the surface area of the bottom surface of the piston 19. In other embodiments, however, the piston may not be pressure balanced. For instance, the collar 39 that is fitted around the lower end of the piston 19 in the illustrated embodiments may be omitted or replaced by one with a smaller diameter. Additionally, or alternatively, the collar 39 may be scalloped or otherwise include flow passages/areas, so that it provides support and registration within the interior cavity 20 of the piston 19, but does not present a significant flow restriction. In such embodiments the surface area of the upper surface of the piston 19 may be at least 50% greater than that of the lower surface of the piston 19.

The result of this would be that, prior to the ball being dropped to initiate the cutting operation, the piston will move much more readily in response to changes in fluid pressure within the drill string. However, the use of a compression spring 26 of suitable properties, and/or the use of suitable shear screws or other frangible connections, will be sufficient to prevent unwanted movement of the piston prior to the commencement of the cutting operation.

It will be understood that tools embodying the invention provide a robust, simple and reliable way for a casing to be cut, in the context of a single-trip operation to seal and abandon a wellbore.

Figure 5:
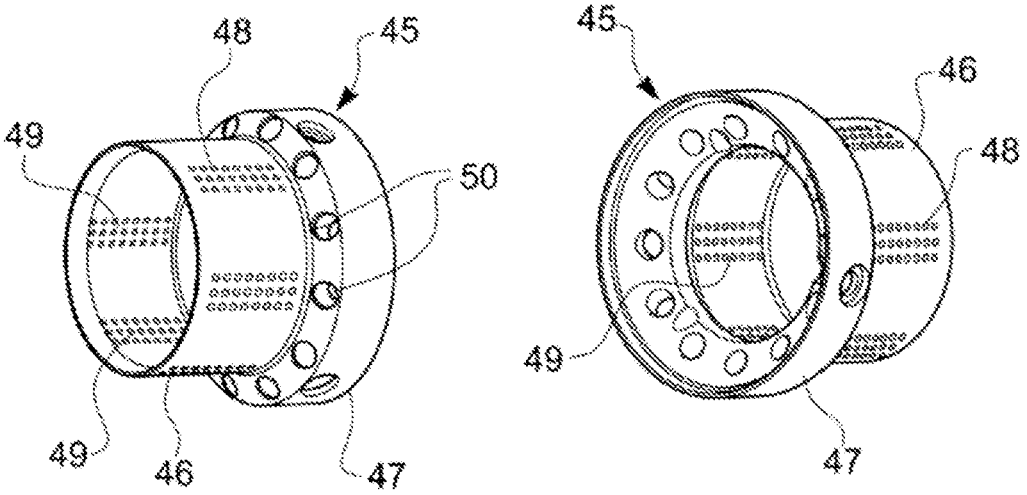
FIG. 5 shows two views of a first debris catcher.
Figure 6:
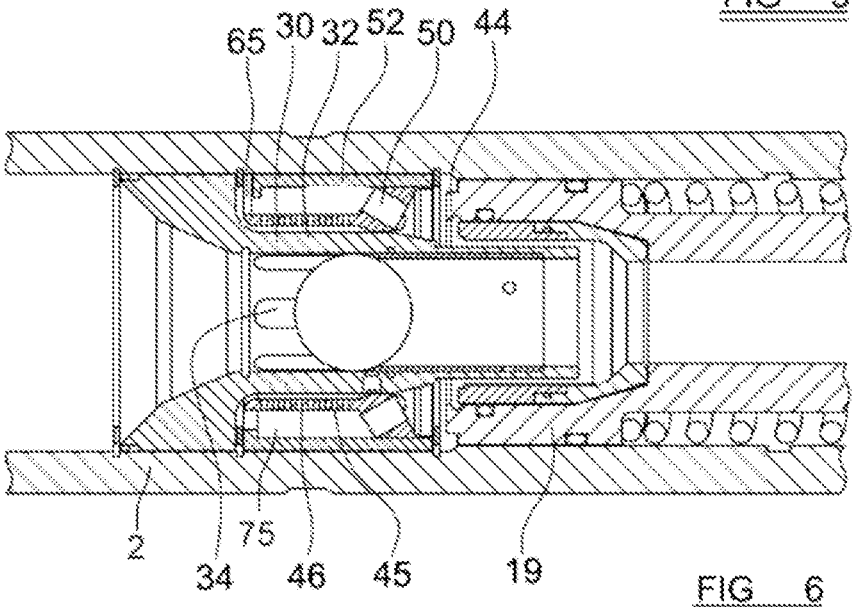
FIG. 6 shows the first debris catcher incorporated into a tool.

FIG. 5 shows two different views of a debris catcher 45, for installation in the space around the delivery portion 32 of the flow regulator 30. FIG. 6 shows the debris catcher 45 when installed in position in the embodiment shown in FIGS. 1-4.

The debris catcher 45 has a sleeve portion 46, which is cylindrical or substantially cylindrical, and which in use is positioned in the annular chamber 75 around the delivery portion 32 of the flow regulator 30, to lie adjacent or near the flow apertures 34. The sleeve portion 46 has a number of holes 48 formed therethrough, which are preferably relatively small, and may for example have a diameter of 0.32 cm (⅛"). In the example shown in FIG. 5, these holes are arranged into a series of groups 49, one of which will (in use) align with each of the flow apertures 34 of the flow regulator 30.

The debris catcher 45 also has a flange portion 47, which is preferably wider than the sleeve portion 46 and protrudes outwardly from one end of the sleeve portion 46, preferably at an angle to the longitudinal axis of the debris catcher 45. The flange portion 47 has a series of apertures 50 formed therethrough. These apertures 50 are preferably larger, and may be significantly larger, than the holes 48 formed through the cylindrical portion 46 of the debris catcher 45.

In use the flange portion 47 is located at the lower end of the sleeve portion 46, so that fluid passing through the sleeve portion 46 may then flow through the apertures 50 of the flange portion 47 to come into contact with the upper end 44 of the piston 19.

The debris catcher 45 may be fixed in place with respect to the flow regulator 30, or another part of the tool 1. In the example shown, the flange portion 47 has attachment points 51 on its outer surface, by which the debris catcher 45 may be attached to a support sleeve 52 (shown in FIG. 6) positioned at the outer side of the annular chamber 75.

The skilled reader will understand that the presence of the debris catcher 45 will help to prevent unwanted solids s from passing through the flow apertures 34 of the flow regulator 30, and thus to maintain reliable operation of the tool 1. Unwanted solids could include, for instance, swarf debris, which may arise from previous operations in the well bore, such as casing milling operations, or from a casing which is corroded or otherwise in poor condition. Such debris could enter circulation from sources such as surface storage tanks or pipe lines which conduct fluid to the well bore.

As can be seen in FIG. 6, when the debris catcher 45 is installed in place around the flow regulator 30, there is preferably a gap between the free end 65 of the cylindrical portion 46 and the underside of the blocking portion 31 of the flow regulator 30. This means that if all, or a large proportion, of the holes 48 formed in the cylindrical portion 46 become blocked, fluid passing through the flow apertures 34 of the flow regulator 30 can pass through this gap, and hence around the cylindrical portion 46 to reach the apertures 50 of the flange portion 47. Blocking of these holes 48 will therefore not stop operation of the tool 1.

Figure 7:
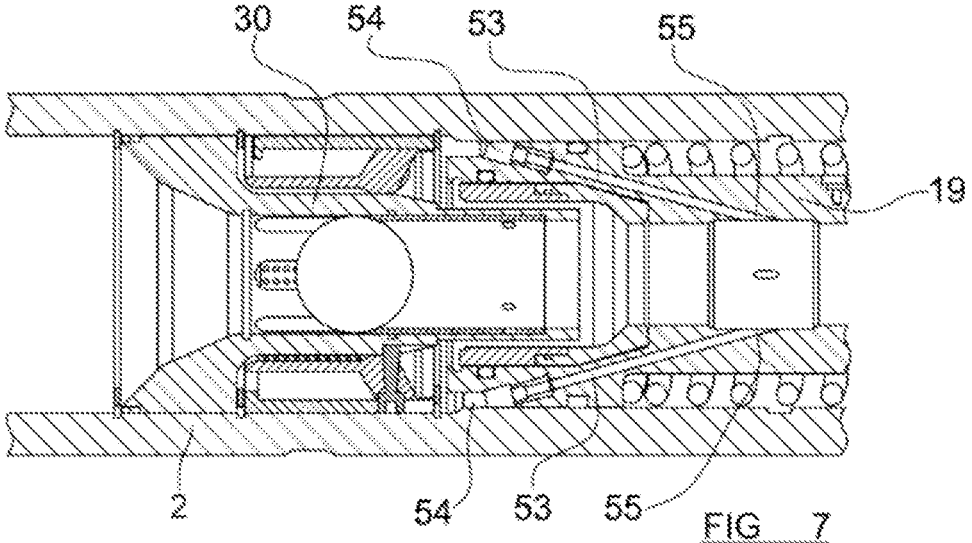
FIG. 7 shows parts of a further tool embodying the present invention.

FIG. 7 shows a variation on the embodiment shown in FIGS. 1-4. In FIG. 7, a series of ports 53 are provided, allowing direct fluid communication between the top end 44 of the piston 19 and the interior cavity 20 of the piston 19, at a location below the flow regulator 30. In the example shown in FIG. 7, the ports 53 are each set at an angle to the longitudinal axis of the piston 19. The ports 53 extend from an inlet 54 formed in the top end 44 of the piston 19, and slant radially inwardly towards an outlet 55 formed in a wall of the interior cavity 20 of the piston 19.

Any suitable number of ports 53 may be provided, spaced radially around the longitudinal axis of the tool 1. For example, one, two, four, eight or twelve ports may be provided.

When the ports 53 are provided, after the ball 68 has been dropped and received in the flow regulator 30, fluid can still circulate through the tool 1, by flowing through the flow apertures 34 of the flow regulator 30, then through the ports 53 and along the interior cavity 20 of the piston 19. With the inclusion of the ports 53, it is still possible to maintain a pressure difference across the piston 19, thus driving the piston 19 downwardly and moving the cutters 12 into a cutting position, by setting a suitable circulation rate. It is expected that the circulation rate will need to be increased in order for this to be possible.

An advantage of including the ports 53 is that the cutters 12 can be activated, and circulation through the tool 1 maintained, so that debris resulting from the cutting of the casing 74 can be carried away by the circulating fluid.

FIG. 7 shows both the ports 53 and the debris catcher 45. It is preferred that the debris catcher 45 (or another filtering arrangement) is used when the ports 53 are provided, to prevent the ports from becoming blocked or clogged. However, the ports 53 may be provided without the debris catcher 45 (and vice versa).

Figure 8:
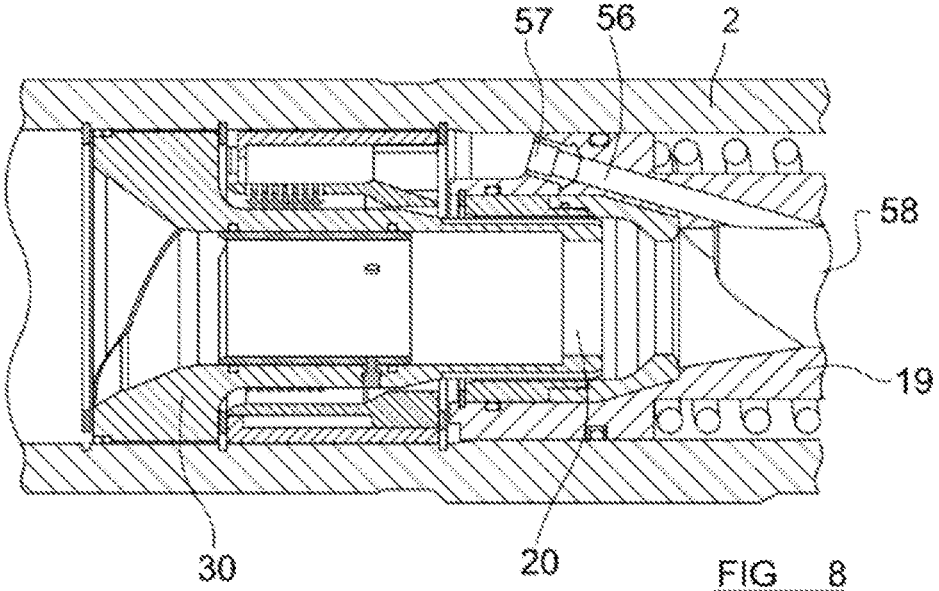
FIG. 8 shows parts of another tool embodying the present invention.

FIG. 8 shows a further variation. In this embodiment, at the top end of the piston 19, the interior cavity 20 (i.e. main bore) of the piston 19 is offset with respect to the central longitudinal axis of the tool 1. In the view shown in FIG. 8, the interior cavity 20 is offset towards the bottom of the page. Preferably the distance of the offset is 0.64 cm (¼"). The result is that the interior cavity is closer to the exterior of the tool 1 on one side of the tool 1 than on the opposite side of the tool 1.

The flow regulator 30 is shaped in an asymmetric manner to fit correctly with the offset interior cavity 20, while still blocking the entirety or substantially the entirety of the wellbore 72, as the skilled person will appreciate.

In preferred embodiments the interior cavity 20 of the piston 19 is offset only in a region near the top end of the piston 19, and further down the piston 19 the interior cavity 20 returns to being centrally or substantially centrally positioned within the tool 1.

If the interior cavity 20 is offset away from the longitudinal axis of the tool in a first direction, this allows a single, relatively wide port 56 to be provided on opposite side of the interior cavity 20, as shown in FIG. 8. As with the ports 53 shown in FIG. 7, the wide port 56 extends from an inlet 57 formed in the top end 44 of the piston 19, and slants inwardly toward an outlet 58 in the wall of the interior cavity 20, at a location below the flow regulator 30.

Forming a single, relatively wide port 56 in this manner allows a greater total flow diameter than can be achieved with the smaller, radially distributed ports 53 shown in FIG. 7. This means that, once the ball 68 has been dropped, a higher flow rate can be maintained through the tool 1. Once again, this is likely to mean that the rate of circulation will need to be increased in order to maintain the necessary pressure difference across the tool 1 to move the cutters 12 to the deployed position, and to maintain the cutters 12 in this position. However, the higher circulation rate will allow debris arising from the cutting of the casing 74 to be carried away more effectively.

Circulation through the tool 1 may also be desired for other reasons, beside carrying away debris. For instance, circulation may be needed for the operation of one or more other tools or components within the drill string.

Figure 9:
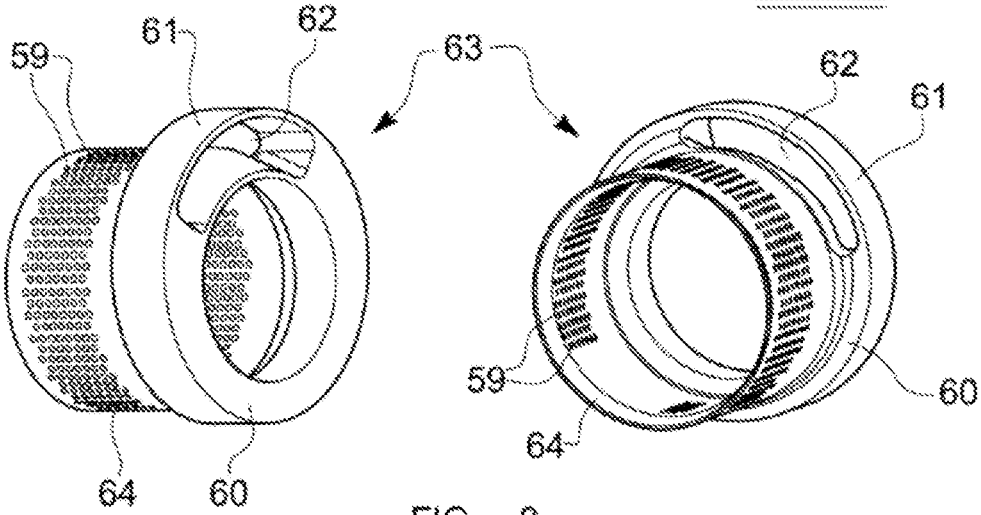
FIG. 9 shows two views of a second debris catcher.

FIG. 9 shows a second debris catcher 63, suitable for use with the embodiment shown in FIG. 8. This second debris catcher 63 is similar to the debris catcher 45 discussed above, having a cylindrical portion 64 with a plurality of holes 59 formed therethrough, which are preferably relatively small. The second debris catcher 63 also has a flange portion 60, which preferably has a generally circular outer perimeter 61, which is offset with respect to the cylindrical portion 64. The flange portion 60 therefore protrudes from one side of the cylindrical portion 64 by a greater amount on a first side than on an opposite second side. On the first side, the flange portion 60 has a single aperture 62 formed therethrough, which is preferably relatively wide. The skilled reader will understand that, when the second debris catcher 63 is installed in the tool 1 (as shown in FIG. 8), the single aperture 62 will be aligned or substantially aligned with the inlet 57 of the port 56. The second debris catcher 63 will function in a similar manner to the debris catcher 45 described above, and while not essential is preferred in this embodiment.

With reference to FIGS. 8 and 9, the above discussion mentions a single port 56, and a single aperture 62 formed in the flange portion 60 of the second debris catcher 63. However, this is not essential and two or more ports 56, and/or two or more apertures 62, may be provided in this embodiment.

It is envisaged that the tool 1 may be used to cut the casing 74 "in tension", as will be understood by the skilled reader. If the casing 74 is resting on the bottom of the well, then the casing's own weight will place the casing in compression.

This may cause the casing 74 to deform (in a manner known as "belly out"), during the cutting process, because the thinner wall may slump outwardly, as it is no longer able to support its own weight. The wall may form a chicane-type shape, leading to a much larger effective thickness or diameter to cut through.

In embodiments, an anchor may be provided as part of the drill string, and in preferred embodiments the anchor is positioned above the tool 1. Before the cutting operation commences (but preferably after the bridge plug is set, if a bridge plug is used) the anchor is engaged with the casing 74, and the casing 74 is lifted upwardly, with the result that the region of the casing 74 that is to be cut is in tension. This will, as the skilled person will appreciate, improve the ease and reliability of the cutting process.

Figure 10:
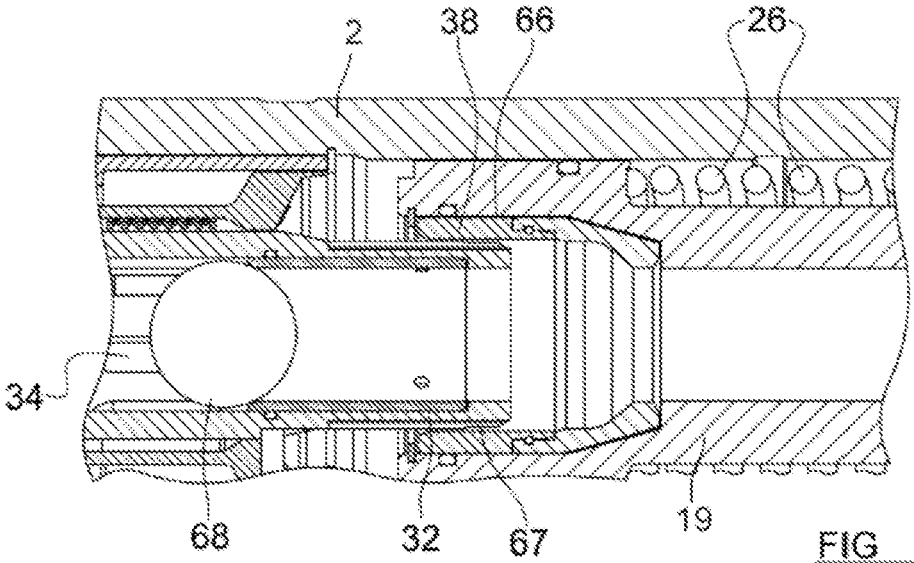
FIG. 10 shows a further tool embodying the present invention.

FIG. 10 shows an alternative embodiment. In the example shown in FIG. 10, the debris catcher 45 is provided, but the ports 53, 56 shown in FIGS. 7 and 8 are not present.

In this example the delivery portion 32 of the flow regulator 30 is concentric with the main longitudinal axis of the tool 1. However, the recess 38 in the upper end of the piston 19 is radially offset with respect to the main longitudinal axis of the tool 1. In the view shown in FIG. 10, the recess 38 in the upper end of the piston 19 is radially offset downwardly, towards the bottom of the page. This means that, on a first side of the delivery portion 32 (the top side, in FIG. 10) the gap 66 between the delivery portion 32 and the recess 38 has a first width, and on a second side of the delivery portion 32 (the bottom side, in FIG. 10) the gap 67 between the delivery portion 32 and the recess 38 has a second, greater width.

The result of this is that, once the ball 68 has been dropped, if fluid is to flow between the exterior of the delivery portion 32 and the interior of the recess 38, to allow flow and circulation during the cutting operation, the gap between the exterior of the delivery portion 32 and the interior of the recess 38 is less likely to become blocked with particles and/or debris. The wider gap 67 on the second side of the delivery portion is more likely to allow particles and debris to pass therethrough.

Providing an offset of this kind allows, for a particular flow area, a relatively wide space which is less likely to become clogged with particles and debris. By comparison, if the delivery portion 32 and the recess 38 were concentric with one another and the same flow area was provided, this flow area would take the form of an annulus, which would be narrow enough at all points to risk becoming clogged.

In the discussion above, the delivery portion 32 is concentric with the main axis of the tool 1, and the recess 38 is offset from this axis. However, in other embodiments this may be reversed, or indeed neither of these components may be fully concentric.

As an example, the gap between the delivery portion 32 and the recess 38 may be 1.1 mm (0.04"), where these components are closest together, and 3.1 mm (0.12") where these components are furthest apart. In an alternative example, the gap between the delivery portion 32 and the recess 38 may be zero (or substantially zero), where these components are closest together, and 4.2 mm (0.16") where these components are furthest apart. The invention is not limited to these examples, however.

As with other examples discussed above, a seal (which may, for example, take the form of a close tolerance ground finished part) may be provided around the outside of the delivery portion 32.

It is also envisaged that filters may be provided at the surface, to remove particulate matter as fluid is circulated through the drill string.

The discussion above mentions a ball being dropped to change the operation of the flow regulator. However, any other suitable method may be used, for instance use of a dart instead of a ball, or an indexing mechanism which can be controlled from the surface through regulation of fluid supplied to the tool.

In the example shown in the drawings, a seat is formed in the flow regulator to receive a ball (or other activation object). In other embodiments the seat may be provided elsewhere in the tool, for instance in the interior of the piston. The skilled reader will appreciate how the tool may be adapted if the seat is provided in a location other than in the flow regulator.

In the embodiments discussed above the delivery portion of the flow regulator has a sealing region 41, and a narrowed region 42. In other embodiments, the delivery portion may omit the narrowed region, but have a shorter overall length, so that when the piston has moved by a certain amount the delivery portion is entirely withdrawn from the piston. Conversely, the delivery portion of the flow regulator may have three or more regions of different external diameters, so that the flow area around the exterior of the delivery portion changes in a series of steps as the delivery portion is withdrawn from the recess in the upper end of the piston. This will lead to a series of corresponding pressure drops, which will be detectable from the surface.

In general, the configuration of the delivery portion 32 of the flow regulator 30, and the recess 38 in the upper end of the piston 19, are preferably such that the flow area between these two components changes at two or more different relative positions of the piston 19 and the flow regulator 30. This will lead to pressure differences which can be detected at the surface, to provide information to operators about the state of the tool 1. For example, when the cutters 12 are in their initial position (shown in FIGS. 1 and 2), in which each cutter 12 touches, or lies close to, the outer surface of the piston 19, a relatively wide part of the delivery portion 32 may come into contact with the interior of the recess 38, leading to a pressure which is may be interpreted by operators at the surface as a sign that the tool 1 is in the initial configuration. As soon as the piston 19 moves away from this position, a narrower part of the delivery portion 32 may come into contact with, or align with, the interior of the recess 38, leading to a detectably lower pressure at the surface.

In the examples discussed above, the sleeve element 35 does not close off the flow apertures 42 completely, and allows the communication of pressure through the flow apertures 42. However, it is also envisaged that the sleeve element 35 may entirely or substantially entirely block the flow apertures 42, so that fluid pressure is not communicated through the flow apertures 42.

This will provide extra protection against the possibility of cement passing through the flow apertures 42 as the cement is displaced through the tool 1.

If this is the case, then before the ball 68 is dropped the pressure acting on the bottom surface of the piston 19 will be significantly greater than the pressure acting on the top surface of the piston 19, as pressurised fluid within the piston 19 will come into contact with the bottom surface of the piston 19, but will be prevented by the sleeve element 35 from acting on the top surface of the piston 19. Forces will therefore act on the piston 19, tending to push the piston 19 in an upward direction. However, as mentioned above, preferably in the initial configuration each cutter 12 lies against an outer surface of the piston 19, and the cutters 12 will therefore prevent upward movement of the piston 19 with respect to the main body 2—this movement would tend to rotate the cutters 12 through the interaction of the teeth 21, 22 of the cutter 12 and the piston 19, and the piston 19 itself blocks this movement.

In this example, the shear screws 28 that initially hold the piston 19 in place longitudinally with respect to the main body 2 may be omitted, since the piston 19 will be maintained by fluid pressure in the initial position until the ball 68 has been dropped (or fluid flow through the flow regulator 30 is somehow otherwise diverted).

It is also envisaged that in other embodiments, i.e. where the sleeve element 35 does allow the communication of fluid pressure through the flow apertures 42, the shear screws 28 may also be omitted.

In some embodiments of the invention, a ball (or other activation object) may be dropped through the drill string to a location in the tool, to divert flow within the tool (as discussed above), and the ball may then be removed from the location in the tool. This preferably has the effect of returning the tool to its state before the ball was initially dropped (aside, potentially, from the fact that the sleeve element will have been moved from its original position, and the flow apertures will remain uncovered).

One technique for this may make use of a ball (or other activation object) which is at least partly dissolvable. Such a ball may be provided, for example, by Dissolvalloy™. The ball may be dropped through the drill string and into the tool, to allow the cutting operation to commence, and then fully or partly dissolved once the cutting operation is complete, so the ball reduces in size sufficiently to pass through the outlet end of the tool. The ball may dissolve (preferably at a predictable rate) through exposure to regular drilling fluid, or there may be a substance which is added to the drilling fluid, at a time chosen by operators at the surface, to cause the ball to dissolve, or accelerate the rate of dissolution.

Another technique for this may make use of a ball which is deformable, for instance being formed from Urethane. A ball of this kind may be dropped through the drill string and into the tool, to allow the cutting operation to commence, and will remain in position within the tool while the pressure above the ball remains below a threshold. However, once the pressure above the ball exceeds the threshold, the ball will deform sufficiently to pass through the tool and out of the outlet end thereof.

In a further technique for this, the ball may be retrieved magnetically, by way of a suitable tool that is passed down the drill string to the tool.

The skilled reader will be aware of other ways in which a ball (or other activation object) may be dropped through the drill string to a location in the tool, and the ball may then be removed from the location in the tool. Once the ball has been removed, the tool will be placed into a state where the piston may be pressure balanced once more. In addition, a higher flow rate through the tool will be possible, without risk of inadvertently activating the cutters.

A further ball (or other activation object) can be dropped through the drill string to the tool, if it is desired to initiate a further cutting operation.

It will be advantageous, although not essential, to ensure that the cutters are held in place longitudinally within the bore as the cutting operation proceeds. As discussed above, in preferred embodiments an anchor or packer is set in the wellbore below the tool, before the cutting operation starts. A packer may be set in the wellbore below the tool, and a cement plug may be formed on top of this packer. In some embodiments, the tool may be longitudinally fixed or registered with respect to this first packer or anchor during the cutting operation. As an alternative a second anchor or packer may be set in the wellbore during operation of the tool, with the tool being longitudinally fixed or registered with respect to this second packer or anchor during the cutting operation. If this component is positioned above the tool, this component should preferably be an anchor, rather than a packer, to allow circulation during the cutting operation. If the component is positioned below the tool then it can be an anchor or packer. If the component is positioned above the tool, it should be retrievable. Whichever option is employed, the tool (or at least the part of the tool that contains the cutters) will be rotationally mounted with respect to the appropriate anchor or packer, for instance by means of one or more bearings, as the skilled reader will understand. It should also be borne in mind that it may be necessary to displace a relatively large quantity of cement through the second anchor or packer, to allow the setting of a plug on the packer that is set in the well bore below the tool.

As an alternative to this, the drill string may be maintained at the correct depth by using some kind of reference in the well bore, at the surface or at the well head. The skilled reader will be aware of both of these options.

It is also envisaged that the drill string may include a cutting or milling head, below the tool, but above the location of a bridge plug or the like. Once the bridge plug has been set and cement displaced onto the bridge plug, the cutting or milling head can be used, if necessary, to remove excess cement and allow access for the cutters to regions of the casing that would otherwise not be accessible because of the presence of the cement.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cutting tool, comprising:

an elongate main body having an inlet end and an outlet end, a fluid flow path being defined between the inlet and the outlet ends, and both the inlet and outlet ends having threaded connections configured for fixing in a drill string;

a piston mounted within the main body and longitudinally movable with respect to the main body;

one or more cutters, each cutter being moveable between a retracted position and a deployed position, wherein the piston and each cutter engage one another so that longitudinal movement of the piston with respect to the main body moves each cutter between the deployed position and the retracted position; and a flow regulator, operable to divert fluid flowing into the inlet end of the tool selectively along a first path, which passes through the piston to the outlet end of the tool, and a second path, in which the fluid is configured to tends to drive the piston longitudinally with respect to the main body.

2. The cutting tool according to claim 1, wherein the piston has a bearing surface and wherein, when fluid flowing into the inlet end of the tool is diverted along the first path, the fluid does not, or substantially does not, come into contact with the bearing surface of the piston, and when fluid flowing into the inlet end of the tool is diverted along the second path, the fluid is diverted into contact with the bearing surface, and wherein pressurised fluid being in contact with the bearing surface is configured to drive the piston longitudinally with respect to the main body.

3. The cutting tool according to claim 1, wherein the flow regulator has one or more flow apertures which are at least partially occluded, in an initial configuration, and in a second configuration the flow apertures are exposed, allowing fluid to flow along the second path.

4. The cutting tool according to claim 1, further comprising a seat in which an activation object may be received, and wherein the activation object at least partially occludes the first path when it is received in the seat.

5. The cutting tool according to claim 4, wherein the seat is formed in the flow regulator or in the piston.

6. The cutting tool according to claim 1, further comprising a biasing arrangement which biases the piston longitudinally with respect to the main body, and wherein, when fluid flowing into the inlet end of the tool is diverted along the second path and is configured to drive the piston longitudinally with respect to the main body, the biasing arrangement is configured to oppose this motion of the piston with respect to the main body.

7. The cutting tool according to claim 1, wherein in a first configuration the piston is prevented from longitudinal movement within the main body by a retaining arrangement, and in a second configuration the piston may move longitudinally with respect to the main body.

8. The cutting tool according to claim 1, wherein the piston has an upper surface, which faces the inlet end of the main body, and a lower surface, which faces the outlet end of the main body, and wherein the surface area of the upper surface is substantially equal to the surface area of the lower surface.

9. The cutting tool according to claim 1, wherein the piston has an upper surface, which faces the inlet end of the main body, and a lower surface, which faces the outlet end of the main body, and wherein the surface area of the upper surface is greater than the surface area of the lower surface.

10. The cutting tool according to claim 9, wherein the surface area of the upper surface of the piston is at least 50% greater than the surface area of the lower surface of the piston.

11. The cutting tool according to claim 1, further comprising one or more ports extending from an inlet, positioned on or near a top end of the piston, to an outlet, which is in communication with an interior cavity of the piston, at a location below the flow regulator.

12. The cutting tool according to claim 1, wherein an internal cavity of the piston is, for at least a part of a length of the piston, offset with respect to a central longitudinal axis of the tool.

13. A method of sealing and cutting a wellbore, comprising:

incorporating a cutting tool according to claim 1 into a drill string by the threaded connections at the inlet and outlet ends of the main body;

running the drill string into a wellbore;

delivering a sealing substance through the drill string, including the cutting tool, to seal or partially seal the wellbore at a position below the cutting tool;

changing an operation of the flow regulator so fluid flowing into the inlet end of the tool is diverted along the second path, so the piston is driven longitudinally with respect to the main body, driving each cutter into the deployed position; and rotating the drill string so that the cutters of the tool cut a casing of the wellbore.

14. The method according to claim 13, further comprising:

incorporating a plug arrangement into the drill string;

activating the plug arrangement within the wellbore; and separating a remainder of the drill string from the plug arrangement.

15. The method according to claim 14, wherein delivering the sealing substance through the drill string comprises delivering the sealing substance onto the plug arrangement after the plug arrangement has been incorporated into the drill string.

16. The method according to claim 13, wherein changing the operation of the flow diverter comprises dropping an activation object through the drill string to a location within the tool.

17. The method according to claim 16, further comprising removing the activation object from the location within the tool once the cutters of the tool have cut the casing of the wellbore.

18. The method according to claim 17, wherein removing the activation object from the location within the tool comprises at least partially dissolving the activation object.

19. The method according to claim 17, wherein removing the activation object from the location within the tool comprises applying sufficient fluid pressure to the tool to drive the activation object out of the location within the tool.

20. The method according to claim 13, further comprising:

including a retrieval arrangement in the drill string; and once the casing of the wellbore has been cut, engaging the casing by means of the retrieval arrangement and removing the casing at least partially from the wellbore.

21. The method according to claim 13, further comprising:

including a milling or drilling tool in the drill string; and after the delivery of the sealing substance through the drill string, removing some of the sealing substance using the milling or drilling tool.

* * * * *